US007311499B2

(12) United States Patent
Hattori et al.

(10) Patent No.: US 7,311,499 B2
(45) Date of Patent: Dec. 25, 2007

(54) IMPELLER APPARATUS FOR WATER PUMP AND WATER PUMP

(75) Inventors: Takumi Hattori, Chiryu (JP); Atsushi Chiba, Toyoake (JP); Makoto Yoshida, Kariya (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/385,725

(22) Filed: Mar. 22, 2006

(65) Prior Publication Data

US 2006/0216164 A1 Sep. 28, 2006

(30) Foreign Application Priority Data

Mar. 24, 2005 (JP) ..... 2005-086906

(51) Int. Cl.
*F04D 29/00* (2006.01)

(52) U.S. Cl. ..... 416/170 R

(58) Field of Classification Search ..... 415/216.1, 415/123; 416/170 R, 169 R
See application file for complete search history.

(56) References Cited

U.S. PATENT DOCUMENTS 5,125,795 A * 6/1992 Suzuki et al. ..... 415/168.2
5,836,271 A * 11/1998 Sasaki et al. ..... 123/41.44
6,960,066 B2 * 11/2005 Koga et al. ..... 417/362

FOREIGN PATENT DOCUMENTS

JP 08-100652 9/1994
JP 2004-052723 7/2002

* cited by examiner

*Primary Examiner*—Ninh H. Nguyen
(74) *Attorney, Agent, or Firm*—Reed Smith LLP; Stanley P. Fisher, Esq.; Juan Carlos A. Marquez, Esq.

(57) ABSTRACT

An impeller apparatus for a water pump includes a driven side rotation body having a shaft portion and a plane portion positioned outside of the shaft portion in a radial direction, the driven side rotation body being arranged coaxially to a drive side rotation body which operates an auxiliary and being connected to the drive side rotation body through the plane portion and an intermediate member provided on an internal periphery of the drive side rotation body to project inwardly in a radial direction to integrally rotate with the drive side rotation body, and an impeller attached on the shaft portion to integrally rotate with the driven side rotation body.

19 Claims, 4 Drawing Sheets

IMPELLER APPARATUS FOR WATER PUMP AND WATER PUMP

CROSS REFERENCE TO RELATED APPLICATIONS

This application is based on and claims priority under 35 U.S.C. §119 with respect to Japanese Patent Application No. 2005-086906 filed on Mar. 24, 2005, the entire content of which is incorporated herein by reference.

FIELD OF THE INVENTION

The present invention relates to an impeller apparatus for a water pump and a water pump.

BACKGROUND

There are various known water pumps. For example, JPH08-100652A (FIG. 3) describes a water pump which includes a drive shaft (38) serving as a drive side rotation body for operating an auxiliary, a driven side rotation body (36) arranged coaxially with and connected to the drive shaft for integrally rotating, and a pump impeller (37) which integrally rotates with the driven side rotation body. According to the construction of the foregoing water pump, the drive shaft and the driven side rotation body are coaxially connected at the shaft center by means of a dog and cam joint or bolt-nut fastening, and the power from the drive shaft is transmitted to the impeller.

A water pump described in JP2004-52723A (FIG. 1) includes driven side rotation bodies (18, 25) which are arranged in parallel with an output shaft of an engine serving as a drive side rotation body, and a pump impeller 30 which integrally rotates with the driven side rotation body. With the construction of the foregoing water pump, the output shaft of the engine and the driven side rotation body are connected by means of a belt to transmit the power from the output shaft.

Because the water pump described in JPH08-100652A is positioned inside a crankcase, the water pump cannot have a visual check. Further, because the driven side rotation body is coaxially and directly connected to the drive shaft at the center of the shaft, high accuracy is required for an alignment of the drive shaft and the driven side rotation body, which increases manufacturing cost in order to maintain the precision. Still further, because the auxiliary, a connecting portion (e.g., a joint), and the water pump are aligned along an axial direction, the space necessary to be ensured for positioning the auxiliary the connecting portion and the water pump in the axial direction is increased.

Particularly, when the drive side rotation body and the driven side rotation body are connected by means of a dog and cam joint and when the joint is made of rigid material (e.g., metal), noise may be generated by metal-to metal contact of the joint.

On the other hand, the water pump described in JP2004-52723 requires ensuring the space for manageability of the belt exclusive for activating the water pump. Further, an outer shape of a pulley serving as the driven side rotation body is required to have highly precise roundness in order to smoothly transmit the rotation, and the manufacturing cost is increased in order to ensure the accuracy. Further, because load from the belt is directly applied to the water pump, parts (e.g., a pulley, a body, and a bearing) are required to have adequate strength and durability.

A need thus exists for an impeller apparatus for a water pump and a water pump, which rotates an impeller by transmitting rotation of the drive side rotation body which operates an auxiliary to the driven side rotation body.

SUMMARY OF THE INVENTION

In light of the foregoing, the present invention provides an impeller apparatus for a water pump, which includes a driven side rotation body having a shaft portion and a plane portion positioned outside of the shaft portion in a radial direction, the driven side rotation body being arranged coaxially to a drive side rotation body which operates an auxiliary and being connected to the drive side rotation body through the plane portion and an intermediate member provided on an internal periphery of the drive side rotation body to project inwardly in a radial direction to integrally rotate with the drive side rotation body, and an impeller attached on the shaft portion to integrally rotate with the driven side rotation body.

According to another aspect of the present invention, a water pump includes a body, a housing fixed to the body, a driven side rotation body having a shaft portion extended to the housing at a first side and a plane portion arranged at outside in a radial direction of the shaft portion, the driven side rotation body being rotatable with the body, an impeller attached at the first side of the shaft portion to integrally rotate with the driven side rotation body, and a drive side rotation body arranged coaxially to the driven side rotation body and having an intermediate member provided projecting from the outside in the radial direction of the plane portion to the plane portion to engage with the plane portion, the drive side rotation body for transmitting rotational force to the driven side rotation body through the intermediate member.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
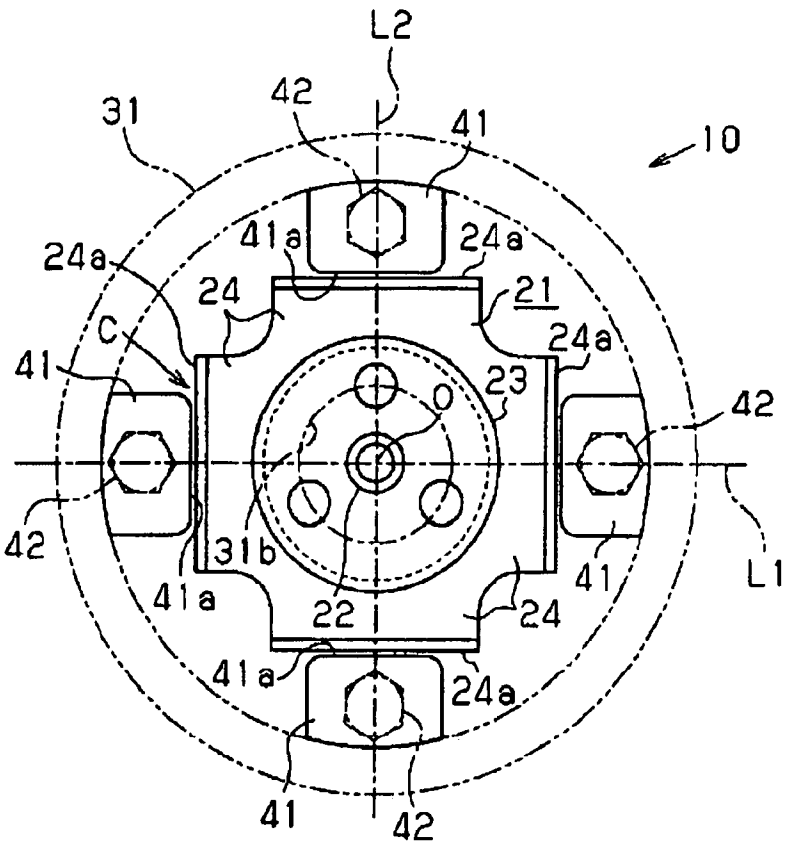
FIG. 1 is a plan view showing a water pump according to an embodiment of the present invention.
Figure 2:
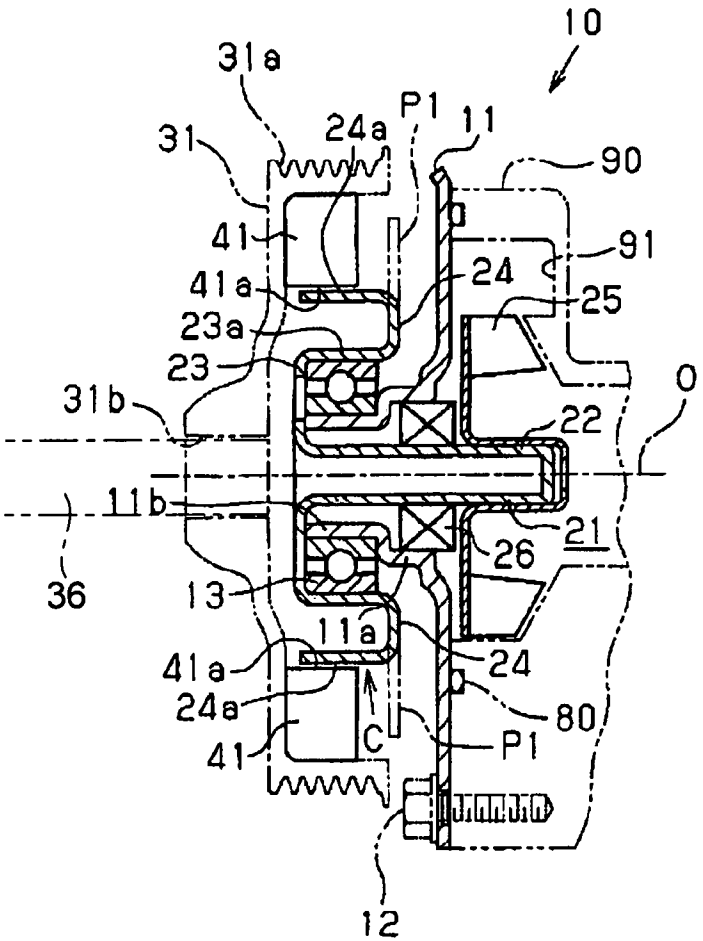
FIG. 2 is a cross-sectional view of the water pump according to the embodiment of the present invention.

An embodiment of the present invention will be explained with reference to illustrations of drawing figures as follows. As shown in FIGS. 1-2, a water pump 10 includes a body 11 which is connected to a housing 90 through a gasket 80, or the like, by means of a fastening means 12. The body 11 includes a stepwise cylindrical portion having a large diameter portion 11*a* and a small diameter portion 11*b*. An inner race of a bearing 13 is press-fitted onto an external periphery of the small diameter portion 11*b*.

A shaft 21 serving as a drive side rotation body is fixed on an outer race of the bearing 13. That is, the shaft 21 is formed by stamping, for example, a steel plate, and integrally includes a shaft portion 22, an arm portion 23, and plural (e.g., four) extended portions 24. The arm portion 23 is formed continuously from a base portion (i.e., an opening base portion) in an axial direction of the shaft portion 22, and in a cylindrical configuration having a bottom outwardly in a radial direction, and opens in an opposite direction of the shaft portion 22. As shown in FIG. 2, the shaft 21 is supported by press-fitting an external peripheral portion 23*a* of the arm portion 23 onto an external periphery of the outer race of the bearing 13. Thus, the shaft 21 is rotatably supported by the bearing 13, or the like.

Each of the extended portions 24 extends by a predetermined angle (e.g., 90 degrees) outwardly in a radial direction continuously from an opening base portion of the arm portion 23, and includes a plane portion 24*a* formed by bending a tip side of the extended portion 24 in an opposite direction of the shaft portion 22 to be in parallel to an axial direction of the shaft. As shown in FIG. 2, more particularly, the plane portions 24*a* are formed by bending plural (e.g., four) plate portions P1 which extends outwardly in a radial direction continuously from an opening base portion of the arm portion 23 by a predetermined angle (e.g., 90 degrees) to be in parallel to the axial direction of the shaft. As shown in FIG. 1, each of the plane portions 24*a* is evenly arranged in a peripheral direction (i.e., a tangential direction around shaft center O at the center of the plane portion 24*a* in a peripheral direction), and the plane portions 24*a* are formed to be line symmetry relative to each corresponding meridian section L1, L2. The extended portion 24 is connected to an auxiliary (i.e., an auxiliary other than the water pump 10).

As shown in FIG. 2, an impeller 25 is fitted onto a tip portion of the shaft portion 22 in an axial direction to be integrally rotatable. The impeller 25 is positioned in a water chamber 91 formed by closing an opening of a concave portion of the housing 90 by the body 11. The water chamber 91 is an element of an engine cooling water channel.

A mechanical seal 26 is provided between an external periphery of the shaft portion 22 and an internal periphery of the large diameter portion 11 a of the body 11 to seal between the water chamber 91 and the bearing 13. The mechanical seal 26 separates the water chamber 91 hermetically from the outside so that the cooling water does not leak to the outside (i.e., bearing 13 side).

The shaft 21 is connected to a pulley 31 serving as a drive side rotation body which operates the auxiliary through plural (e.g., four) intermediate members 41 to integrally rotate with the pulley 31. More particularly, the pulley 31 is formed cylindrically having a bottom and opens towards the shaft 21 side, and rotates integrally with a drive shaft which is secured to an attaching hole 31*b* provided in the center thereof by transmitting the power from the output shaft of the engine by means of a belt applied to an external periphery portion 31*a* of the pulley 31. The pulley 31 activates the auxiliary through the drive shaft which is secured to the attaching hole 31*b*.

The pulley 31 is arranged coaxially to the shaft 21 (i.e. shaft portion 22) on the shaft center O. The plural intermediate members 41 are connected to the pulley 31 to integrally rotate each other. Each of the intermediate members 41 is made of flexible material such as rubber or resin. Length of the intermediate member 41 in the axial direction is shorter than the length of an internal periphery of the pulley 31. The intermediate members 41 are provided projecting from an internal periphery of the pulley 31 inwardly in a radial direction, and are fastened to the pulley 31 by means of a fastening bolt 42. In this circumstance, all of the intermediate members 41 are accommodated inside the pulley 31.

A face of the intermediate member 41 at internal peripheral side includes an engaging surface 41*a* which faces the plane portion 24*a* in a radial direction and is engaged with the plane portion 24*a*. Accordingly, a part of the shaft 21 (i.e., arm portion 23, and extended portion 24) is housed inside of the intermediate member 41 along with other parts such as the bearing 13. As shown in FIG. 1, each of the engaging surfaces 41*a* is evenly extended in a peripheral direction which is perpendicular to the meridian section L1, L2 which runs through on the center of the engaging surface 41*a* in the peripheral direction (i.e., a tangential direction around the shaft center O at the center of the engaging surface 41*a* in the peripheral direction) (i.e., each of the engaging surfaces 41*a* is arranged to be either perpendicular to or in parallel to the meridian section L1, L2). And each of the engaging surfaces 41*a* is formed to be line symmetry relative to the meridian section L1, L2. A width of the engaging surfaces 41*a* in the peripheral direction is shorter than a width of the plane portion 24*a*. Further, when the meridian section L1, L2 which is drawn though the center of the engaging surface crosses the center of the plane portion 24*a* in the peripheral direction, each of the engaging surfaces 41*a* is set at a position where the length from the shaft center O to the plane portion 42*a* in the radial direction is slightely longer than the length from the shaft center O to the engaging surface 41*a*.

Accordingly, a clearance C is formed between the engaging surface 41*a* and the plane portion 24*a* when the meridian section L1, L2 which runs through the center of the engaging surface 41*a* crosses the center of the plane portion 24*a* in the peripheral direction. The clearance C absorbs deviation of the shaft center when assembling the pulley 31 which is provided with the intermediate member 41 to the shaft 21.

Thus, the shaft 21 which engages with the engaging surface 41*a* at the plane portion 24*a* integrally rotates with the pulley 31 by pushing the plane portion 24*a* onto the engaging surface 41*a* in accordance with the rotation of the pulley 31.

When the power from the output shaft of the engine is transmitted to the pulley 31 through the belt applied on the external peripheral portion 31*a* of the pulley 31 with the foregoing construction, the pulley 31 activates the auxiliary in accordance with the rotation thereof through the drive shaft secured to the attaching hole 31*b*. In this circumstance, the rotation of the pulley 31 is transmitted to the shaft 21 through the intermediate member 41, and the pulley 31 and the shaft 21 integrally rotate. Then, the impeller 25 which is unitarily provided on the shaft 21 rotates in the water chamber 91. Accordingly, the cooling water filled in the water chamber 91 is pushed out to be a current of the cooling water which circulates in the cooling water channel.

According to the embodiment of the present invention, the following effects can be obtained.

According to the embodiment of the present invention, the rotation of the pulley 31 which activates the auxiliary is transmitted to the shaft 21 through the plane portion 24*a* engaged with the intermediate member 41 to rotate the impeller 25. Although the pulley 31 and the shaft 21 for the transmission of the rotation are coaxially arranged, precision required for aligning the pulley 31 and the shaft 21 can be reduced because a deviation of the shaft center of the pulley 31 and the shaft 21 can be absorbed by slides between the plane surface 24*a* of the extended portion 24 and intermediate member 41 along the plane portion 24*a*. For example, the precision for assembling the shaft 21 to the pulley 31 can be reduced through the plane portion 24*a* which is engaged with the intermediate member 41.

Further, because highly precise roundness is not required for the driven side rotation body compared to the case for transmitting the rotation of the drive side rotation body (i.e., pulley) to the driven side rotation body (i.e., shaft) through the belt, it is allowed to reduce the manufacturing quality (i.e., machining accuracy). Because it is not necessary to have manageability of the belt exclusively for the water pump, the space can be effectively used.

According to the embodiment of the present invention, because the plane portion 24*a* is formed by bending the plate portion P1 extended outwardly in the radial direction to be in parallel to the axial direction, the plane portion 42*a* can be formed easily by bending, and thus the manufacturing cost of the shaft 21 is reduced.

According to the embodiment of the present invention, by housing the plane portion 24*a* inside the pulley 31 having a cylindrical shape with a bottom along with a part of the shaft 21 (e.g., arm portion 23), the pulley 31, the intermediate member 41, and the shaft 21 are connected at a position in an axial direction which overlaps with the pulley 31 in the radial direction. Because the pulley 31, the intermediate member 41, and the shaft 21 are connected overlapped one another in the radial direction, space necessary to be ensured in the axial direction as a whole can be reduced.

According to the embodiment of the present invention, the water pump 10 which can rotate the impeller 25 by transmitting the rotation of the pulley 31 which activates the auxiliary to the shaft 21 without requiring high precision for the assembling and machining, is provided.

According to the embodiment of the present invention, the intermediate member 41 is made of flexible material. With this construction, because the rotation between the pulley 31 and the shaft 21 is buffered by the intermediate member 41 to be transmitted, generation of a noise can be restrained.

According to the embodiment of the present invention, because the load applied to the belt is not directly applied to the water pump 10, the strength and the durability required for the parts (e.g., body 11, bearing 13) can be moderated. Thus, longevity of the parts of the water pump 10 can be increased, and providing the capability of the excessive performance to the water pump is avoided to reduce the manufacturing cost. Particularly, because the strength required for the bearing 13 is moderated, and the bearing 13 can be reduced in size.

According to the embodiment of the present invention, because the water pump 10 and the auxiliary other than the water pump 10 can be arranged to activate coaxially, the loading capacity of the water pump 10 in the engine can be improved.

According to the embodiment of the present invention, because a part of the water pump 10 is enclosed by the pulley 31, infiltration of external objects into the inside of the bearing 13 can be restrained.

According to the embodiment of the present invention, because the water pump 10 is fixed on the housing 90 as an outside attachment, a visual check can be conducted easily.

The foregoing embodiment can be varied and modified, for example, as follows.

The number of the plane portion 24*a* and the intermediate member 41 can be varied from one to any plural numbers. In case the plural plane portions 24*a* and the intermediate members 41 are provided, it is preferable to arrange plane portion and the intermediate member which make a pair evenly by a predetermined angle considering balancing for transmitting the rotation.

Figure 3:
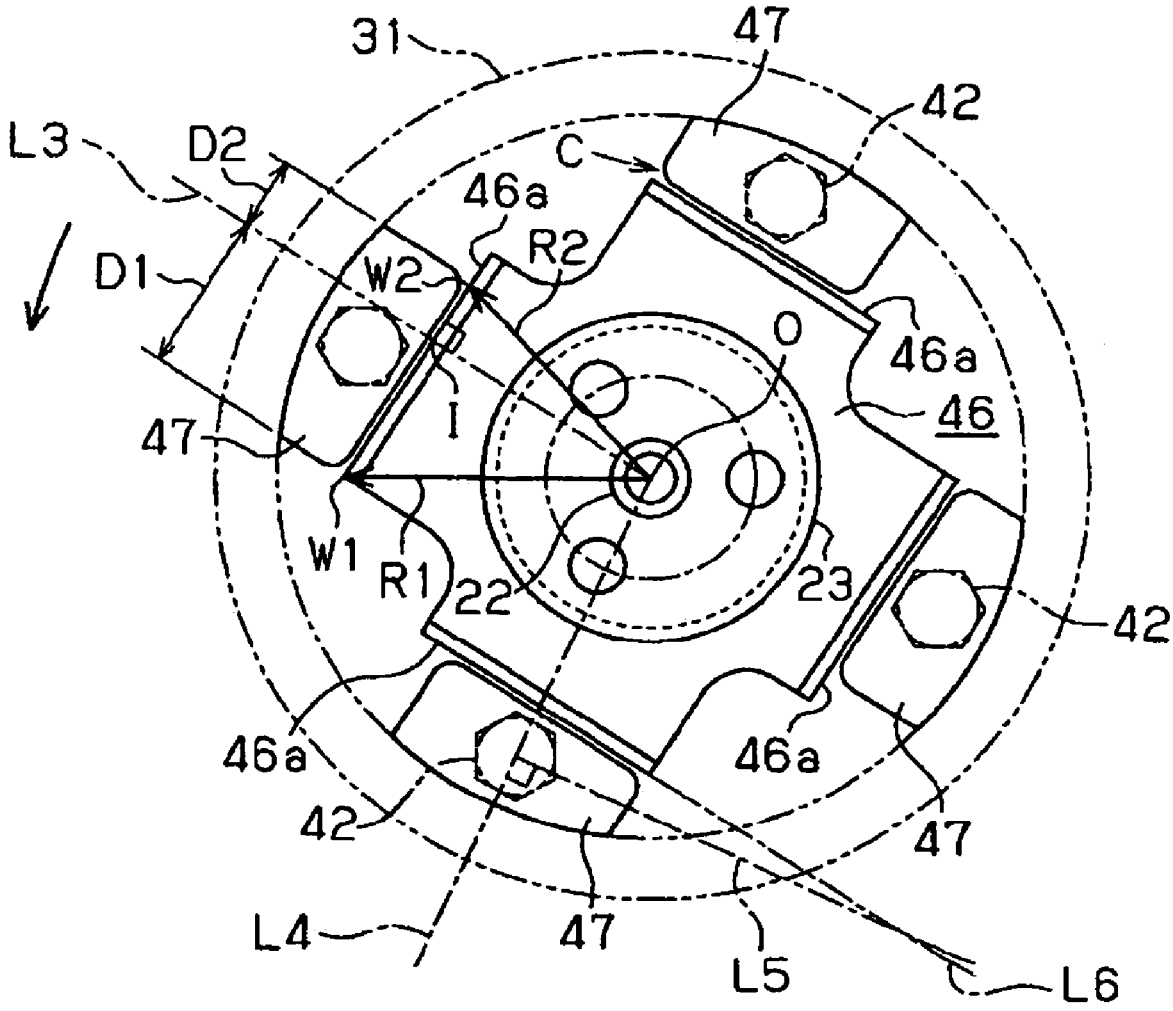
FIG. 3 is a plan view showing a first modified example according to the present invention.

For example, the water pump 10 includes a shaft 46, shown in FIG. 3, including plane portions 46*a* unevenly provided in a rotational direction, and intermediate members 47 corresponding to the plane portion 46*a* are provided on the pulley 31. That is, at the plane portion 46*a*, length D1 from an intersection I between the plane portion 46*a* and meridian section L3 which crosses vertical to the plane portion 46*a* to working point W1 of the intermediate member 47 at a most advancing side in a rotational direction is set to be longer than length D2 from the intersection I to working point W2 of the intermediate member 47 at a most reverse side in a rotational direction. In those circumstances, length R1 from the shaft center O to the working point W1 of the intermediate member 47 at the most advancing side in the rotational direction is set to be longer than length R2 from the shaft center O to the working point W2 of the intermediate member 47 at the most reverse side in the rotational direction, and thus a drive torque to be transmitted to the shaft 46 (i.e., plane portion 46*a*) is increased compared to the case where the length R1 and the length R2 are set to be equal.

With the shaft 46 shown in FIG. 3, it is set that line L5 in a peripheral direction (i.e., a tangential direction around the shaft center O at the center of the intermediate member 47 in a peripheral direction) which is vertical to meridian section L4 which runs through the center of the intermediate member 47 in a peripheral direction and an extended line L6 of the plane portion 46*a* crosses. Accordingly, the plane portion 46*a* increases an element of rotational force received from the intermediate member 47, and thus increases the efficiency in rotation.

Figure 4:
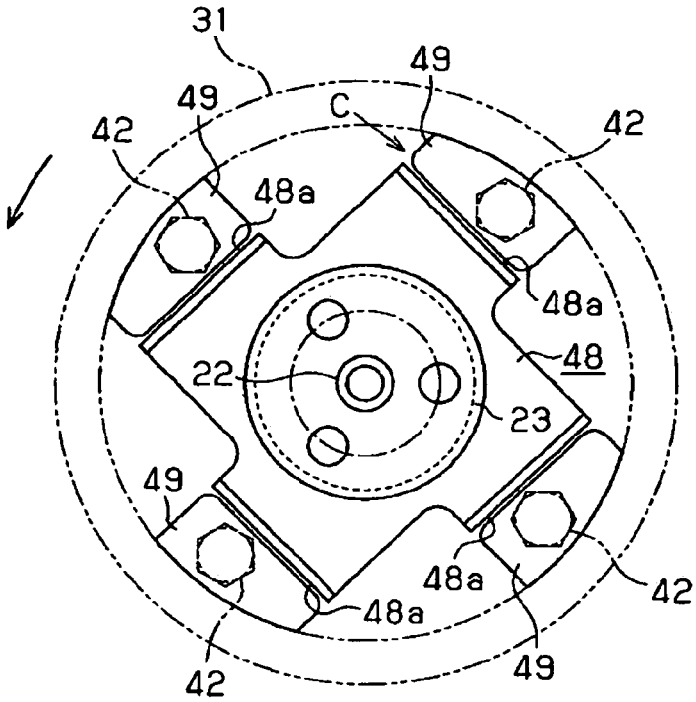
FIG. 4 is a plan view showing a second modified example according to the present invention.

A second modified example will be explained as follows. As shown in FIG. 4, the water pump 10 includes a shaft 48 including further unevenly arranged plane portions 48*a* in a rotational direction. An intermediate member 49 corresponding to each of the plane portion 48*a* is arranged unevenly from a fixing portion (i.e., fastening bolt 42) in a rotational direction.

Figure 5:
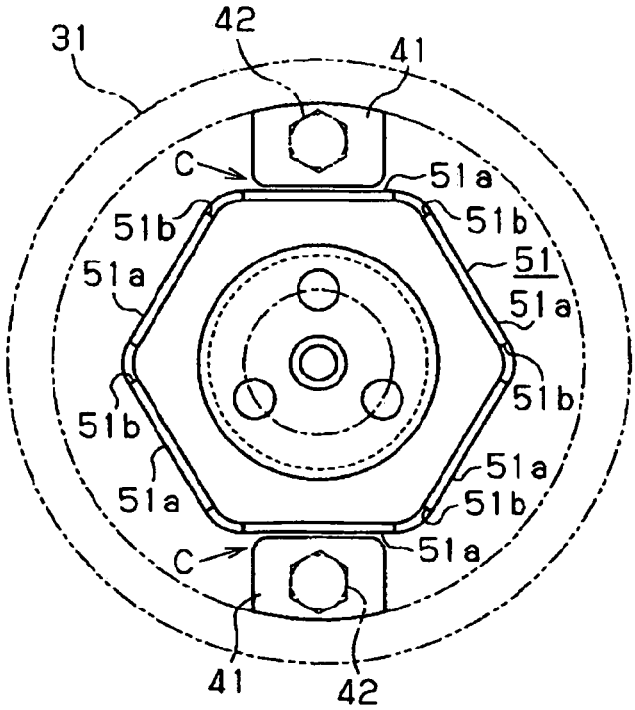
FIG. 5 is a plan view showing a third modified example according to the present invention.
Figure 6A:
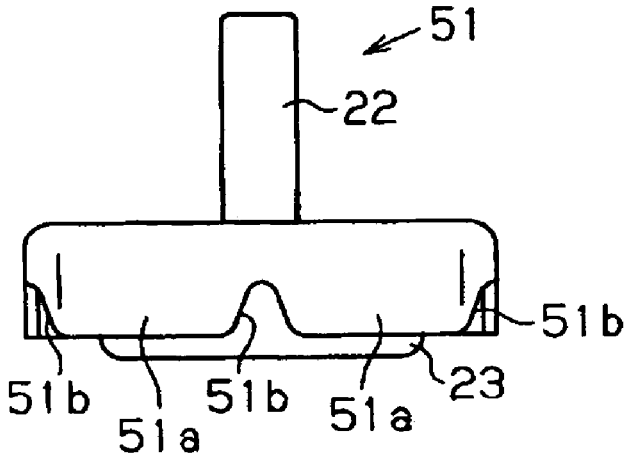
FIG. 6A is a lateral view showing a shaft according to the third modified example of the present invention.
Figure 6B:
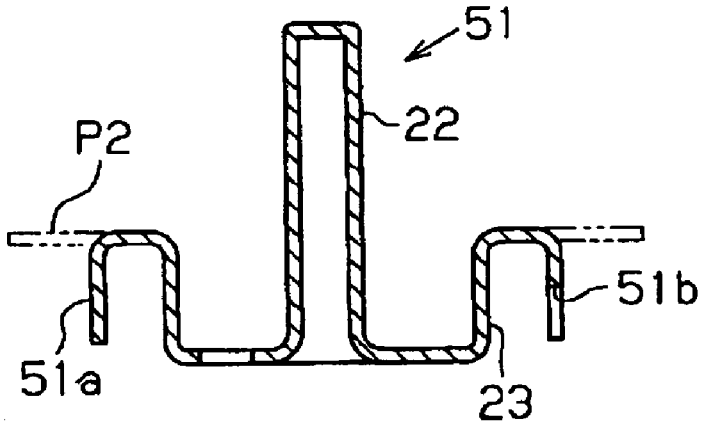
FIG. 6B is a cross-sectional view showing the shaft according to the third modified example of the present invention.

A third modified example will be explained as follows. As shown in FIGS. 5 and 6A, 6B, the water pump 10 includes a shaft 51 which includes plural (e.g., six) plane portions 51*a* continuously provided each other for forming a polygonal cylinder (e.g., hexagon). As shown in FIG. 6B, the plane portion 51*a* is formed by bending an annular plate portion P2 formed continuously from an opening end portion of the arm portion 23 and extended outwardly in a radial direction in an opposite direction of the shaft portion 22 in an axial direction. The plane portions 51*a* are formed by stamping (drawing), and a recess 51*b* is formed between adjacent plane portions 51*a* for facilitate the processing. The intermediate member 41 is provided on the pulley 31 and projects from the internal periphery of the pulley inwardly in a radial direction. The intermediate members 41 are provided on one of a pair of plane portions (i.e., two plane portions) which faces each other in a radial direction. The number of the intermediate member 41 may be equal to or more than one (i.e., up to six for a hexagonal cylinder), and it is preferable that the number of the intermediate member 41 is to be even number (e.g., two, four, or six) considering the balancing for transmitting the rotation. With the construction of the third modified example, because the plural plane portions 51*a* are formed continuously to form the polygonal cylinder, the strength of the plural plane portions 51*a* can be ensured.

The intermediate members 41, 47, 49 may be made of rigid material such as metal.

In this case, the strength of the intermediate members 41, 47, 49 can be ensured with a simple manufacturing method.

According to the embodiment of the present invention, the pulley 31 and the shaft 21, or the like, may be arranged separately in an axial direction. For example, the drive shaft secured to the pulley 31 (i.e., attaching hole 31*b*) is extended to the intermediate member 41 side, and a fixing portion serving as the drive side rotation body which is connectable to the intermediate member 41 is secured to the drive shaft. At the fixing portion, the shaft 21 is coaxially connected to the pulley 31 through the intermediate member 41. In this case, as freedom of placement of the pulley 31 in the axial direction increased, and the design freedom can be increased.

According to the embodiment of the present invention, although the shaft 21 which integrally includes the shaft portion 22, the arm portion 23, and the extended portion 24 is adopted, the shaft 21 may be constructed with plural parts as long as the shaft 21 is connected to the impeller 25 to integrally rotate.

According to the embodiment of the present invention, the shaft 21 may be manufactured by resin molding or other methods.

Although the drive side rotation body (i.e., pulley 31) which is rotated by the output shaft of the engine is adopted according to the embodiment of the present invention, other drive side rotation body which is rotated by another drive shaft or by an electric motor. The power transmission to the drive side rotation body is not limited to the transmission by means of the belt, and may be transmitted by means of a gear engagement, or the like.

According to the embodiment of the present invention, the auxiliary which the drive side rotation body (i.e., pulley 31) rotates includes an air conditioner, an alternator, a pump for a power steering, a vacuum pump, or the like.

According to the present invention, a water pump includes a driven side rotation body having a plane portion arranged outside in a radial direction, the driven side rotation body being arranged coaxially to a drive side rotation body which operates an auxiliary and being connected to the drive side rotation body through the plane portion and an intermediate member provided on an internal periphery of the drive side rotation body to project inwardly in a radial direction to integrally rotate with the drive side rotation body, an impeller which integrally rotates with the driven side rotation body, a body which forms a water chamber where the impeller is positioned, a bearing provided between the body and the driven side rotation body to rotatably support the driven side rotation body, and a mechanical seal which seals between the water chamber and the bearing.

According to the embodiment of the present invention, the rotation of the drive side rotation body which operates the auxiliary is transmitted to the drive side rotation body through the plane portion which is engaged with the intermediate member to rotate the impeller. Although the drive side rotation body and the driven side rotation body for transmitting the rotation are arranged coaxially, because a deviation of the shaft center between the drive side rotation body and the driven side rotation body can be absorbed by a slide between the plane portion and the intermediate member along the plane portion, the accuracy required for alignment can be reduced. For example, the assembling precision of the driven side rotation body relative to the drive side rotation body are reduced through the plane portion which engages with the intermediate member.

According to the embodiment of the present invention, high precision of the roundness is not required, and the processing precision can be reduced. Further, because manageability for the belt exclusively for the water pump is not necessary, space can be used effectively.

According to the embodiment of the present invention, because the plane portion is formed by bending the plate portion extended outwardly in a radial direction to be in parallel to the axial direction, the plane portion can be formed easily by bending.

According to the embodiment of the present invention, the plural plane portions formed by bending the annular plate portion extended outward in a radial direction to be in parallel to the axial direction are arranged continuously to have a polygonal cylindrical configuration, the strength thereof can be ensured.

According to the embodiment of the present invention, the length from the intersection of the plane portion and the meridian section which crosses vertical to the plane portion to the working point of the intermediate member at the most advancing side in the rotational direction is set to be longer than the length from the intersection to the working point of the intermediate member at the most reversing side in the rotational direction. Accordingly, at the plane portion, the length from the shaft center to the working point of the intermediate member at the most advancing side in the rotational direction is set to be longer than the length from the shaft center to the working point of the intermediate member at the most reversing side in the rotational direction, and thus the drive torque which is transmitted to the drive side rotation body is increased compared to the case where the both lengths are set at the same length.

According to the embodiment of the present invention, the line in the peripheral direction which crosses vertically to the meridian section which runs through the center of the intermediate member in a peripheral direction and the extended line of the plane portion cross each other, and elements of the rotational force that the plane portion receives from the intermediate member is increased, and the efficiency of the rotation is improved.

According to the embodiment of the present invention, because the plane portion is housed inside of the cylindrical pulley having the bottom along with the intermediate member, the pulley, the intermediate member, and the driven side rotation body are connected at an axial position which overlaps with the pulley (i.e., drive side rotation body) in a radial direction. Accordingly, the space to ensure in the axial direction as a whole can be reduced by connecting the pulley, the intermediate member, and the drive side rotation body overlapping in a radial direction.

According to the embodiment of the present invention, the water pump which rotates the pump impeller by transmitting the rotation of the drive side rotation body which operates the auxiliary without the high assembling precision and processing precision can be provided.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An impeller apparatus for a water pump comprising:

a driven side rotation body having a shaft portion and a plane portion which is positioned outside of the shaft portion in a radial direction and has a plane surface extended in an axial direction, the driven side rotation body being arranged coaxially to a drive side rotation body which operates an auxiliary, and the driven side rotation body being connected to the drive side rotation body through the plane surface of the plane portion and an intermediate member provided on an internal periphery of the drive side rotation body to project inwardly in a radial direction to integrally rotate with the drive side rotation body; and an impeller attached on the shaft portion to integrally rotate with the driven side rotation body.

2. The impeller apparatus for the water pump according to claim 1, wherein the plane portion is formed by bending a plate portion extended outwardly in a radial direction from the shaft portion to be in parallel to an axial direction.

3. The impeller apparatus for the water pump according to claim 2, wherein length from an intersection of the plane portion and a meridian section, which is vertical to the plane portion and runs through a shaft center, to a working point of the plane portion with the intermediate member at an advancing side in a rotational direction is set to be longer than length from the intersection to a working point of the plane portion with the intermediate member at a reversing side in the rotational direction.

4. The impeller apparatus for the water pump according to claim 2, wherein the intermediate member and the plane portion are arranged so that a line which vertically crosses a meridian section running through a shaft center and the center of the intermediate member in a peripheral direction, and an extended line of the plane portion cross each other.

5. The impeller apparatus for the water pump according to claim 1, wherein the plane portion includes a plurality of plane portions, and the plurality of plane portions are formed by bending an annular plate portion extended outwardly from the shaft portion in a radial direction to form a polygonal cylindrical configuration being in parallel to an axial direction.

6. The impeller apparatus for the water pump according to claim 5, wherein length from an intersection of the plane portion and a meridian section, which is vertical to the plane portion and runs through a shaft center, to a working point of the plane portion with the intermediate member at an advancing side in a rotational direction is set to be longer than length from the intersection to a working point of the plane portion with the intermediate member at a reversing side in the rotational direction.

7. The impeller apparatus for the water pump according to claim 5, wherein the intermediate member and the plane portion are arranged so that a line which vertically crosses a meridian section running through a shaft center and the center of the intermediate member in a peripheral direction, and an extended line of the plane portion cross each other.

8. The impeller apparatus for the water pump according to claim 1, wherein length from an intersection of the plane portion and a meridian section, which is vertical to the plane portion and runs through a shaft center, to a working point of the plane portion with the intermediate member at an advancing side in a rotational direction is set to be longer than length from the intersection to a working point of the plane portion with the intermediate member at a reversing side in the rotational direction.

9. The impeller apparatus for the water pump according to claim 1, wherein the intermediate member and the plane portion are arranged so that a line which vertically crosses a meridian section running through a shaft center and the center of the intermediate member in a peripheral direction, and an extended line of the plane portion cross each other.

10. The impeller apparatus for the water pump according to claim 1, wherein the drive side rotation body is a cylindrical pulley having a bottom, and the plane portion is housed inside of the pulley along with the intermediate member.

11. A water pump comprising:

a body;

a housing fixed to the body;

a driven side rotation body having a shaft portion which is extended to the housing at a first side and a plane portion which is arranged at outside in a radial direction of the shaft portion and has a plane surface extended in an axial direction, the driven side rotation body being rotatable to the body;

an impeller attached at the first side of the shaft portion to integrally rotate with the driven side rotation body; and a drive side rotation body arranged coaxially to the driven side rotation body and having an intermediate member provided projecting from the outside in the radial direction of the plane portion to the plane portion to engage with the plane surface of the plane portion, the drive side rotation body for transmitting rotational force to the driven side rotation body through the intermediate member.

12. The water pump according to claim 11, wherein the drive side rotation body is a cylindrical pulley having a bottom which includes an attaching portion to which a drive shaft for operating an auxiliary at a bottom portion thereof is attached.

13. The water pump according to claim 11, wherein the plane portion is formed by bending a plate portion extended outwardly in a radial direction from the shaft portion to be in parallel to an axial direction.

14. The water pump according to claim 11, wherein the plane portion include a plurality of plane portions, and the plurality of plane portions are formed by bending an annular plate portion which extends outwardly in a radial direction from the shaft portion in a polygonal cylindrical configuration being in parallel to an axial direction.

15. The water pump according to claim 11, wherein length from an intersection of the plane portion and a meridian section, which is vertical to the plane portion and runs through a shaft center, to a working point of the plane portion with the intermediate member at an advancing side in a rotational direction is set to be longer than length from the intersection to a working point of the plane portion with the intermediate member at a reversing side in the rotational direction.

16. The water pump according to claim 11, wherein the intermediate member and the plane portion are arranged so that a line which vertically crosses a meridian section running through a shaft center and the center of the intermediate member in a peripheral direction, and an extended line of the plane portion cross each other.

17. The water pump according to claim 11, wherein the drive side rotation body is a cylindrical pulley having a bottom, and the plane portion is housed inside of the pulley along with the intermediate member.

18. The water pump according to claim 11, wherein the intermediate member includes an end face at an internal peripheral side including an engaging surface which is positioned facing the plane portion in a radial direction of the shaft portion.

19. The water pump according to claim 18, wherein the engaging surface and the plane portion form a clearance therebetween in a radial direction of the shaft portion when a meridian section which runs through a shaft center of the shaft portion and the center of the engaging surface in a peripheral direction crosses the center of the plane portion in a radial direction.

* * * * *